US009492020B1

(12) United States Patent
Morrell

(10) Patent No.: US 9,492,020 B1
(45) Date of Patent: Nov. 15, 2016

(54) DISPLAY RACK

(71) Applicant: Chicago Display Company, River Grove, IL (US)

(72) Inventor: Jordan Morrell, Chicago, IL (US)

(73) Assignee: Chicago Display Company, River Grove, IL (US)

( * ) Notice: Subject to any disclaimer, the term of this patent is extended or adjusted under 35 U.S.C. 154(b) by 0 days.

(21) Appl. No.: 14/802,797

(22) Filed: Jul. 17, 2015

(51) Int. Cl.
*A47F 5/04* (2006.01)
*A47F 5/00* (2006.01)
*A47F 5/10* (2006.01)

(52) U.S. Cl.
CPC ..... *A47F 5/04* (2013.01); *A47F 5/0018* (2013.01); *A47F 5/10* (2013.01)

(58) Field of Classification Search
CPC ..... A47F 5/04; A47F 5/10; A47F 5/0018; A47F 5/02; A47F 5/05; A47F 5/0068; A47F 5/13; A47B 2220/0038; A47B 57/42; A47B 96/061; A47B 2013/025; A47B 57/46; A47B 57/56; A47B 96/06; A47B 87/0246
USPC ..... 211/133.4, 205, 193, 194, 196, 133.1, 211/207, 208, 128.1, 187, 107, 126.1, 211/106.01, 163, 126.4, 126.5, 133.3; 108/91, 191, 101, 157.13, 31; 248/159
See application file for complete search history.

(56) References Cited

U.S. PATENT DOCUMENTS 277,711 A 5/1883 Groff
937,155 A * 10/1909 Krasne ..... A47F 5/02 211/165
1,749,750 A * 3/1930 Bailey ..... A47B 13/14 108/59
2,890,801 A * 6/1959 Ladd ..... A61B 17/3215 211/205
3,051,319 A * 8/1962 Glaser ..... A47F 5/04 211/133.4
3,513,986 A * 5/1970 Schier ..... A47F 5/04 211/1
3,889,817 A * 6/1975 Berkman ..... G11B 23/0236 206/387.14
4,060,214 A * 11/1977 Metcalf ..... A47F 5/04 248/165
4,270,461 A * 6/1981 Schramm ..... A47F 5/04 108/31
4,345,526 A * 8/1982 Streit ..... A47F 5/04 108/101
4,453,640 A * 6/1984 Cillario ..... A47F 5/13 211/133.4
4,528,914 A 7/1985 Montet
4,865,283 A * 9/1989 Parker ..... A47F 5/04 108/191
4,976,359 A 12/1990 Hardy
(Continued)

OTHER PUBLICATIONS

Gridwall Displays. http://www.kc-store-fixtures.com/gridwall-4-way-pinwheel-unit. Dated Jan. 1, 2015.

*Primary Examiner* — Joshua Rodden
*Assistant Examiner* — Hiwot Tefera
(74) *Attorney, Agent, or Firm* — Jansson Munger McKinley & Kirby Ltd.

(57) ABSTRACT

A display rack including a support, one or more bracket attached to the support and merchandise supports, such as shelves, supported by each bracket. The support may be a vertical support and a plurality of bracket mounting locations may be spaced vertically along the support. Each bracket may include adjoined first and second beams. The beams may be adjoined proximate the inner ends and extend to free outer ends. Each beam may include a leading side which faces in a common forward clockwise or counter-clockwise direction about the support. Each shelf may be secured with respect to the leading side of each beam and may extend from the leading side in the forward direction. The brackets and shelves may be configured to present merchandise entirely around the rack for improved merchandise visibility and accessibility.

14 Claims, 8 Drawing Sheets

(56) References Cited

U.S. PATENT DOCUMENTS

| | | | | |
|---|---|---|---|---|
| 5,033,626 | A | 7/1991 | Platti | |
| 5,669,494 | A * | 9/1997 | Geffen | G11B 33/045 206/309 |
| 5,704,497 | A | 1/1998 | Wyatt | |
| 5,715,955 | A | 2/1998 | Hannecke | |
| 5,735,415 | A * | 4/1998 | Wilson | A47B 57/42 211/187 |
| 5,906,284 | A * | 5/1999 | Hammerstrom | B25H 1/02 211/107 |
| 6,138,842 | A * | 10/2000 | Rios | A47F 5/10 211/133.4 |
| 6,837,386 | B1 * | 1/2005 | Kent | A47B 96/027 108/151 |
| D526,818 | S | 8/2006 | Sparkowski | |
| 7,083,052 | B1 | 8/2006 | Morle | |
| D565,324 | S | 4/2008 | Sparkowski | |
| D573,369 | S | 7/2008 | Sparkowski | |
| 8,020,714 | B2 | 9/2011 | Miller, Jr. et al. | |
| 8,534,472 | B2 | 9/2013 | Levine et al. | |
| 8,720,706 | B2 * | 5/2014 | Robbins, III | A47F 5/02 211/133.1 |
| 8,733,563 | B2 | 5/2014 | Fadrowski | |
| 8,807,356 | B2 | 8/2014 | Weigand et al. | |
| 2005/0194337 | A1 * | 9/2005 | McDaniel | A47B 96/061 211/165 |
| 2011/0089127 | A1 * | 4/2011 | Thomas | A47F 5/02 211/163 |

* cited by examiner

DISPLAY RACK

FIELD

The invention relates to display racks and, more particularly, to display racks which can provide improved merchandise presentation and accessibility.

BACKGROUND

In certain merchandising applications it can be important to present merchandise to customers in a highly visible manner and with merchandise accessibility provided from multiple different directions relative to the presentation. Customers may be more likely to purchase merchandise if the merchandise can be more easily seen and accessed. Further, and given constraints on valuable retail floor space, it can be important to present merchandise to customers within a compact footprint.

Display racks represent one means by which to present merchandise to customers. However, such racks are not optimal in accomplishing the above-mentioned objectives.

In short, there is a need for an improved display rack which provides for highly visible and accessible merchandise presentation within a compact footprint to thereby increase opportunities for merchandise sales.

SUMMARY

The present invention is an improvement in display racks. Embodiments of the rack can be implemented to provide a visible and accessible merchandise presentation within a compact footprint.

In embodiments, a display rack may comprise a support, a bracket with adjoined first and second beams attached to the support and a merchandise support secured to each beam. Each merchandise support may be a shelf.

In embodiments, the rack support may include a base and a pole which extends up from the base and defines an upright axis. At least one, and preferably a plurality, of mounting locations may be provided along the axis. The plurality of mounting locations may be spaced vertically along the axis. It is preferred that the pole have a polygonal cross-section and at least one pair of opposed first and second parallel vertical walls.

One or more bracket may be attached to the support at each of the mounting locations. In certain embodiments, a pair of the brackets are attached to the support at each mounting location. The bracket or brackets may be attached to the pole with a single fastener extending through the brackets and support.

In embodiments, the adjoined first and second beams of the bracket may have a leading side, adjoined inner ends and free outer ends. The first and second beams may be at an angle relative to each other. Each of the beams may be substantially vertical and each beam may be substantially flat. Each beam may be tapered such that the beam has a greater vertical dimension at the adjoined inner end than the free outer end and has a lower edge including a tapered portion between the beam ends.

Each beam may extend outward from the inner end and support such that each leading side faces in a common forward direction. The common direction may be clockwise or counterclockwise about the support axis.

Each bracket may have a generally L-shaped appearance. In certain embodiments, the first beam may be at approximately a right angle with respect to the second beam. If a pair of the generally L-shaped brackets are attached to the support at each of the mounting locations, it is preferred that each adjacent beam at each mounting location is at approximately a right angle to the other adjacent beam.

The beams may be made more robust and stable with respect to the rack support through inclusion of certain structural features. For example, a substantially planar flange may be provided at an upper edge of each beam and the flange provides rigidity to the beam. In embodiments, the flange may be bent along the upper edge of the beam outward from the trailing side to a substantially right angle with respect to the trailing side. The flange may have an inward flange edge which contacts a vertical pole wall to limit lateral movement of the beam and bracket.

As a further example, a protrusion which may be a tab-type protrusion, may extend from the first beam along the same vertical pole wall as the inward flange edge. Contact between the protrusion and vertical pole wall limits downward rotation of the bracket with respect to the pole and further stabilizes the bracket with respect to the pole.

A shelf-type merchandise support may be secured with respect to the leading side of each beam in the forward direction. In embodiments, a shelf may include a set of hooks each extending from a rear side of the shelf into a corresponding shelf-supporting hole defined by the corresponding flange of the beam to which the shelf is attached. The rear side of the shelf may be positioned against the leading side of the corresponding beam so that the shelf extends in the forward direction. Merchandise may be presented entirely around the rack for improved merchandise visibility and customer access to the merchandise. Other aspects of the display rack are described in the drawings and detailed description which follow.

BRIEF DESCRIPTION OF THE DRAWINGS

Exemplary display racks may be understood by reference to the following description taken in conjunction with the accompanying drawings, in which like reference numerals identify like elements throughout the different views. The drawings are not necessarily to scale, emphasis instead being placed upon illustrating the principles of the invention. The drawings depict only embodiments of the invention and are not therefore to be considered as limiting the scope of the invention. In the accompanying drawings.

DETAILED DESCRIPTION

Figure 1:
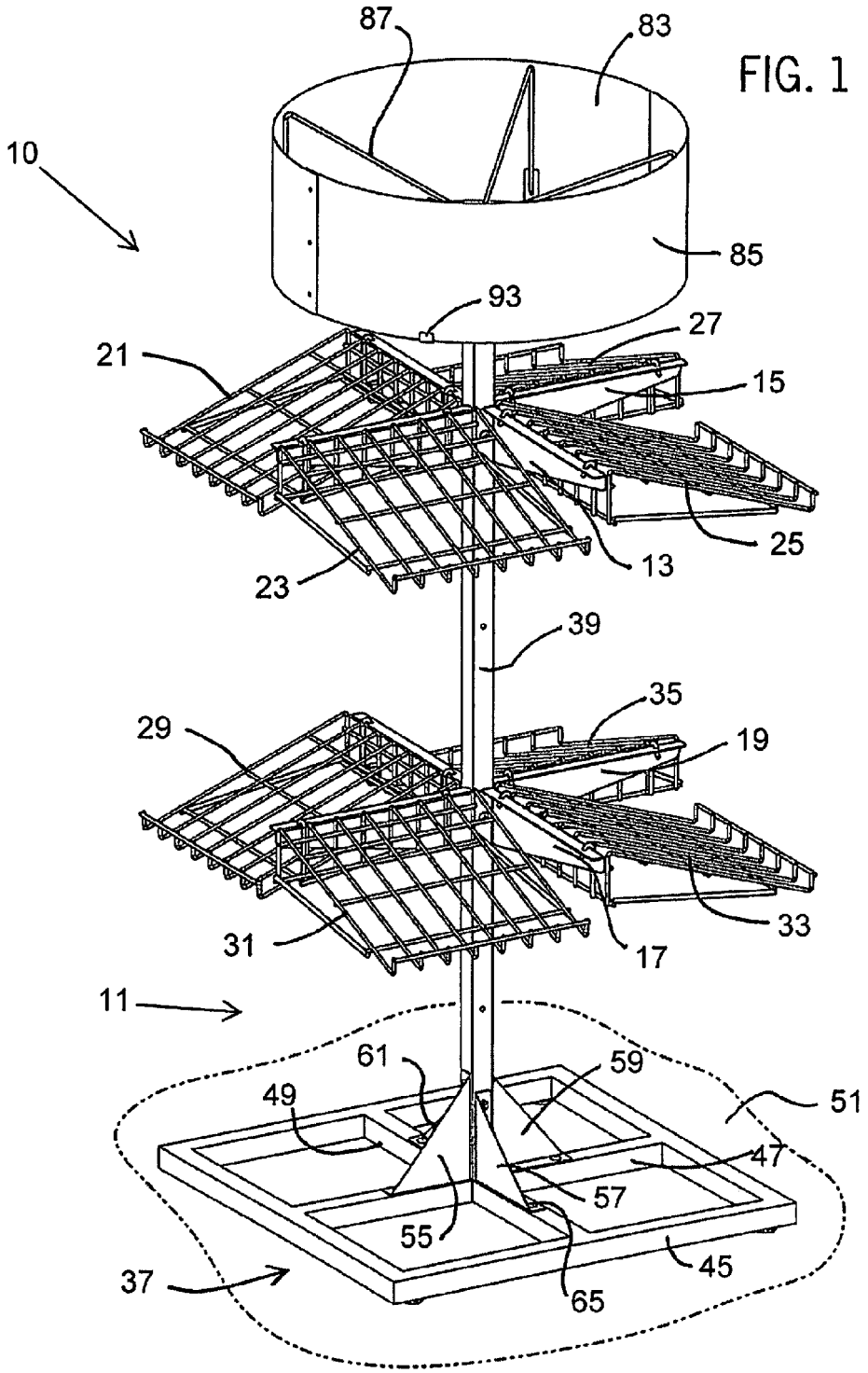
FIG. 1 is a perspective view of a display rack in accordance with an embodiment of the invention.

Referring first to FIGS. 1-12, there is shown an exemplary embodiment of a display rack with accessible shelves 10, referred to herein simply as a "rack" 10. Each rack 10 may be configured to present merchandise to a customer in a highly visible and easily accessible manner. And, rack 10 may be configured with a compact footprint to optimize retail floor space. To simplify the drawings and to avoid obscuring the drawings, only certain of various identical rack components are indicated by reference numbers, it being understood that like component(s) not indicated by a reference number have the same structure and function as the indicated component(s).

Referring then to the examples of FIGS. 1-12, rack 10 includes a support 11, brackets 13, 15, 17, 19 and merchandise supports comprising shelves 21, 23, 25, 27, 29, 31, 33, 35 in the illustrated embodiment. Support 11 may include a base 37 and a vertical pole 39 with a first (i.e., lower) end 41 and a second (i.e., upper) end 43. Pole 39 may extend up from base 37 with first end 41 closest to base 37 and second end 43 furthest from base 37. In the examples, base 37 may comprise a tubular outer frame 45 and tubular internal cross rails 47, 49 forming a rigid, 4-sided generally rectangular planar structure which rests on a floor 51 or other surface to provide a secure base of support for rack 10.

Figure 2:
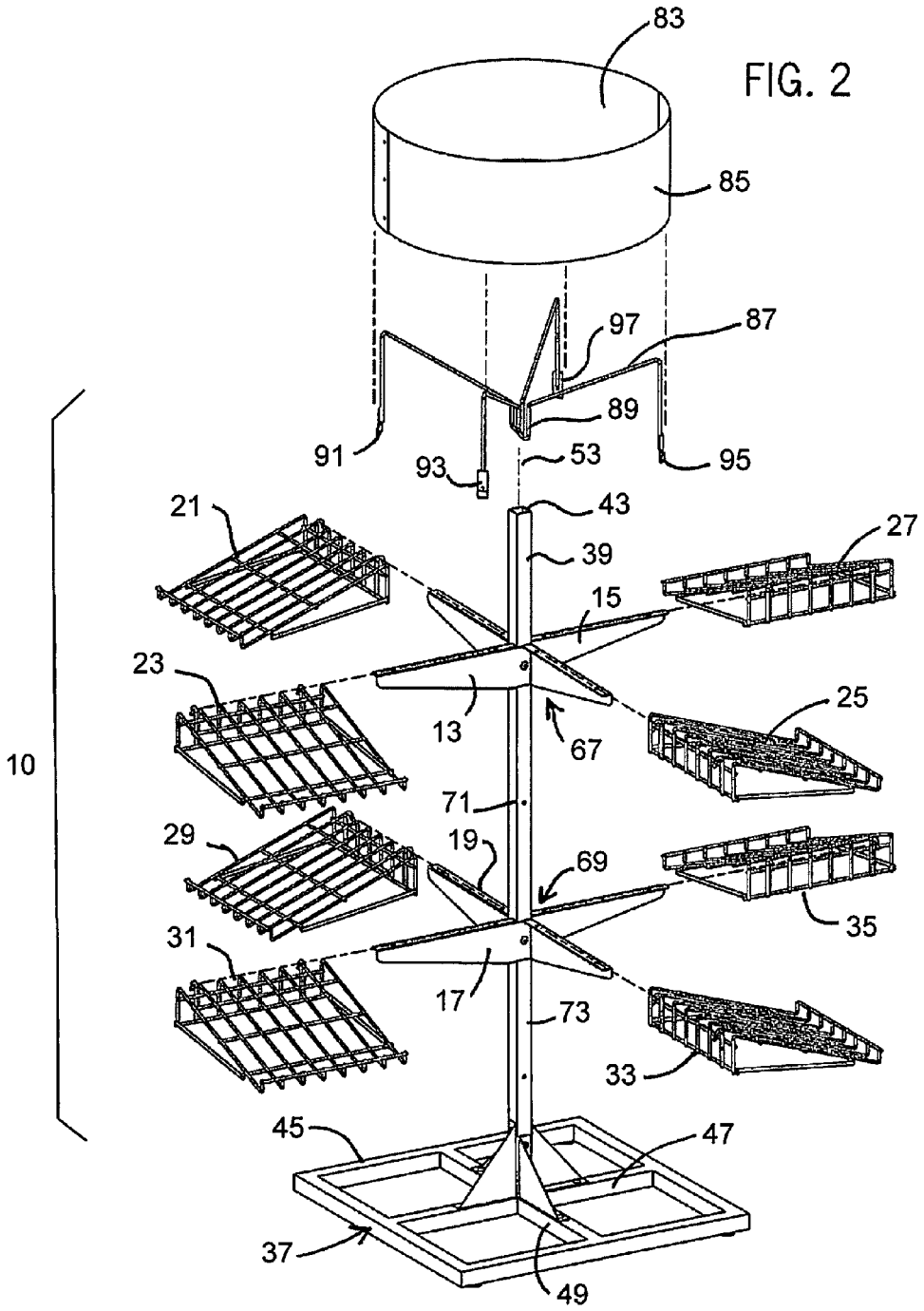
FIG. 2 is an exploded perspective view of the display rack of FIG. 1.

Pole 39 may be an axial pole defining an upright axis 53. Upright axis 53 may be a vertical axis as illustrated in FIG. 2. Pole 39 of support 11 may be a tubular member rigidly secured vertically on base 37 by means of gussets 55, 57, 59, 61 secured to a cross rail 47, 49 and pole 39. Base 37, pole 39 and gussets 55-61 may be secured together, for example, by mechanical fasteners (e.g., 63, 65) where assembly and disassembly may be desired (e.g., for rack 10 compactness for storage or shipment) or by welding where a permanent connection between base 37 and pole 39 is desired. Pole 39 may, for example, be 72 inches in length. In other embodiments, pole 39 may also be a plural-component pole (not shown) with sections nested together when assembled. Base 37, including frame 45 and cross rails 47, 49, and pole 39 may, for example, be of hollow tubular material having a cross section in a direction at a right angle to axis 53 which may be a polygon, rectangle or any suitable cross sectional configuration. It is not required that pole 39 have four sides or be generally rectangular in cross section because other cross sectional configurations, such as triangular, pentagonal and other polygonal cross-sectional configurations are acceptable in certain embodiments. Base 37 and pole 39 may be of steel, aluminum or any other material of sufficient strength to support rack 10.

Figure 3:
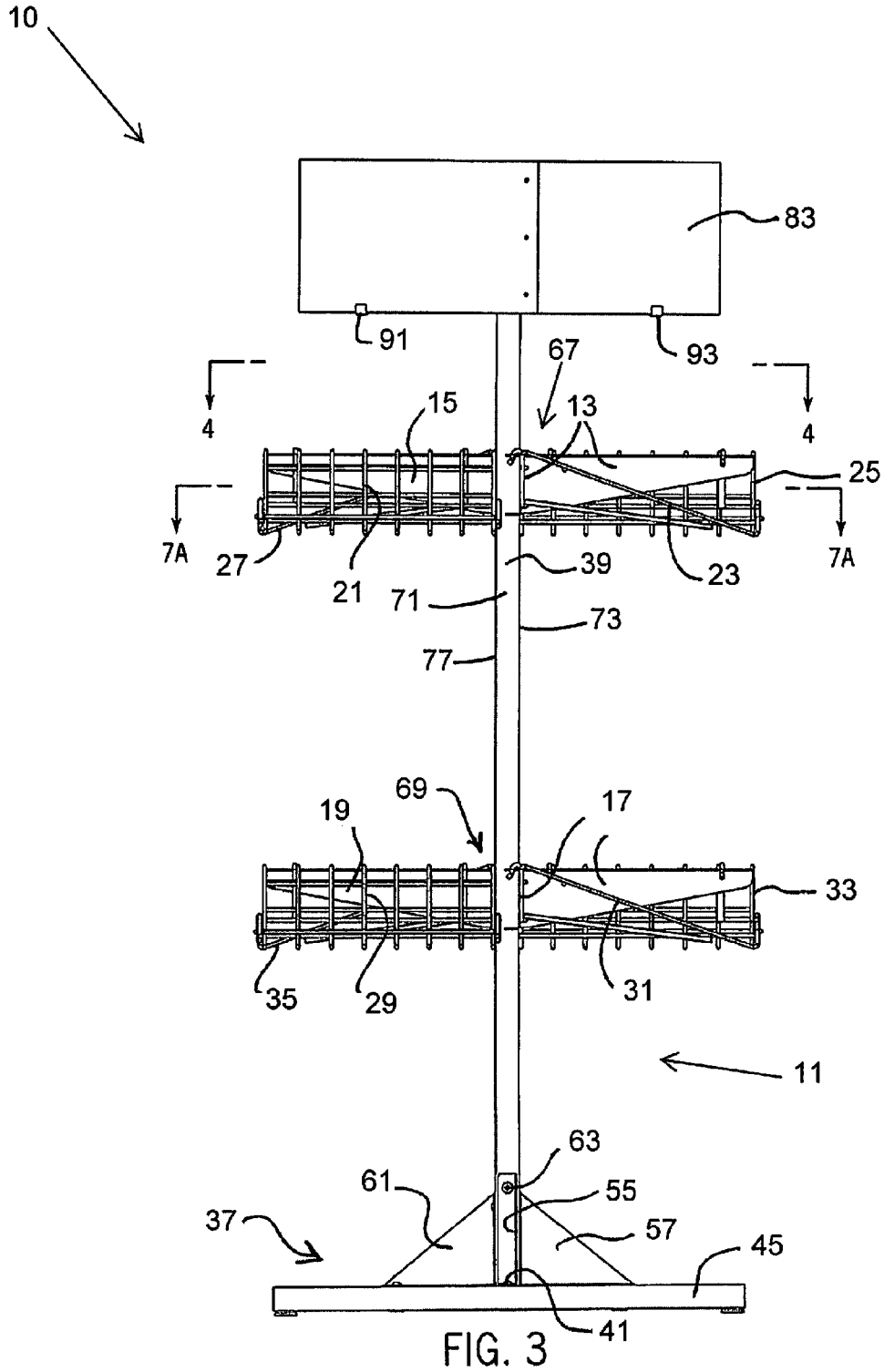
FIG. 3 is a side elevation view of the display rack of FIG. 1, but rotated from the position of the rack of FIG. 1.
Figure 4:
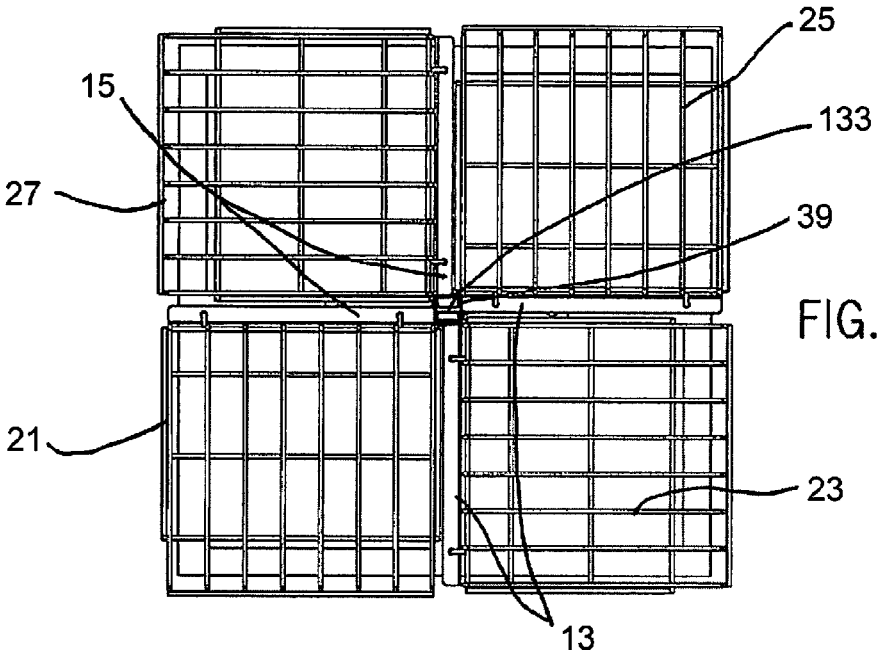
FIG. 4 is a section view taken along section 4-4 of FIG. 3.
Figure 5:
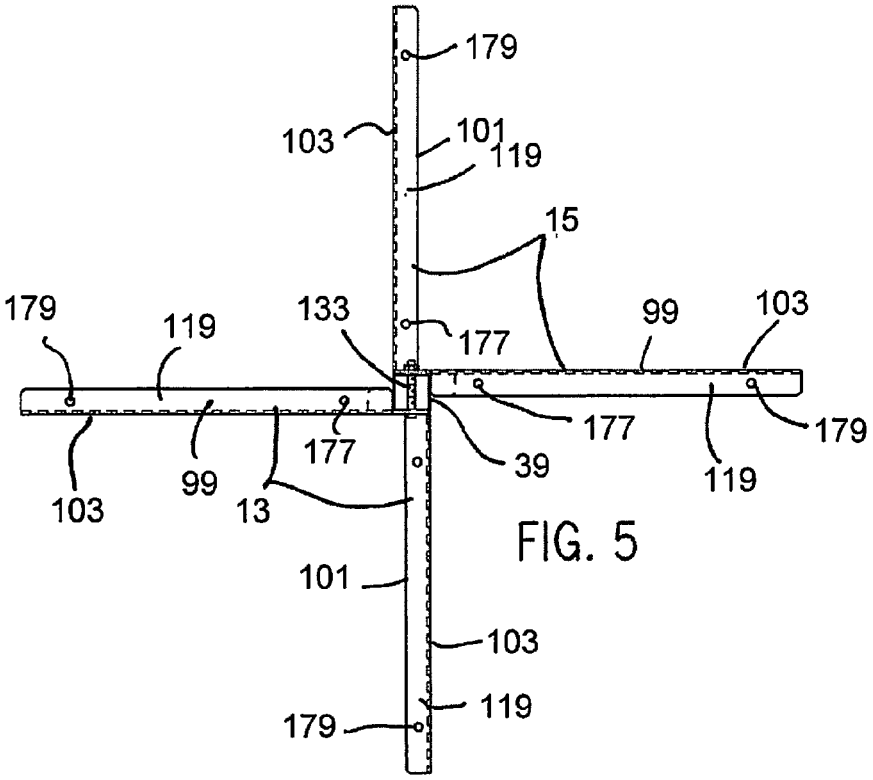
FIG. 5 is a top plan view of the display rack of FIG. 1 but with shelf, placard and base components removed.

Referring to FIGS. 1-3, pole 39 may include a plurality of bracket mounting locations 67, 69 spaced vertically and axially from each other along pole 39 and along axis 53. In the examples of FIGS. 1-3, two bracket mounting locations 67, 69 are illustrated but it is to be understood that one or any number of bracket mounting locations could be provided based on the iteration of rack 10 implemented.

As illustrated in FIGS. 1-7B, pole 39 of support 11 may include at least one pair of opposed first and second parallel vertical walls 71, 75. In the exemplary four-sided pole 39 illustrated, a second pair of opposed first and second parallel vertical walls 73, 77 are provided. Each mounting location 67, 69 may be defined by a mounting passage 79 or 81, through pole 39. In the examples, each mounting passage may be an axial hole through pole 39 opposed parallel vertical walls 71, 75 or 73, 77, preferably at a right angle to pole 39 axis 53. As described below, the opposed parallel vertical walls 71, 75 and 73, 77 enable brackets 13, 15, 17, 19 to be positioned around pole 39 facing in different directions around pole 39 to provide improved merchandise display and presentation entirely around pole 39.

FIGS. 1-3 illustrate that a placard 83 may optionally be provided at second end 43 of pole 39 for placement of indicia, images or other information that may be related to the merchandise displayed on rack 10. In the examples, placard 83 may be of an annular design with an outer surface 85 for display of information thereon. Placard 83 may be of any suitable material including plastic, metal, and paperboard. Placard 83 may be secured to pole 39 by means of holder 87. Holder 87 may be of bent wire construction with an inner insert end 89 and a plurality of upwardly facing u-shaped ends 91, 93, 95, 97 radially outward from insert end 89. U-shaped ends 91-97 clip onto and hold a bottom edge of placard 83. Insert end 89 of holder 87 may be sized to fit snugly within second end 43 of pole 39 to hold placard 83 firmly on rack 10 by means of a friction fit with pole 39.

Referring again to FIGS. 1-12, an aspect of rack 10 which enables presentation of merchandise fully around rack 10 for optimal merchandise presentation is brackets 13, 15, 17, 19 located at a respective one of the bracket mounting locations 67, 69. In the examples, each bracket 13, 15, 17, 19 may support a pair of merchandise supports which may be a pair of shelves the shelves 21, 23, 25, 27, 29, 31, 33. As an example, FIGS. 1-3 illustrate bracket 13 supporting shelves 23 and 25 with brackets 15, 17, 19 supporting a shelf pair in a like manner. In the examples shown in FIGS. 1-3, four brackets 13, 15, 17, 19 are illustrated, with two brackets 13 and 15 and 17 and 19 at a respective mounting location 67, 69. It is to be understood that any number of brackets could be utilized based on the iteration of rack 10 implemented.

In the examples, each bracket 13, 15, 17, 19 includes adjoined first and second beams 99, 101 each having a leading side 103 and a trailing side 105. Each beam 99, 101 extends outwardly from pole 39 of support 11 such that each leading side 103 faces in a common forward direction. The common forward direction may be one of either clockwise or counterclockwise about pole 39 axis 53. In the examples, a merchandise support in the form of a shelf, e.g., shelf 21, is secured with respect to the leading side 103 of each beam 99, 101 extending from such leading side 103 in the forward direction as described in more detail below.

Figure 11:
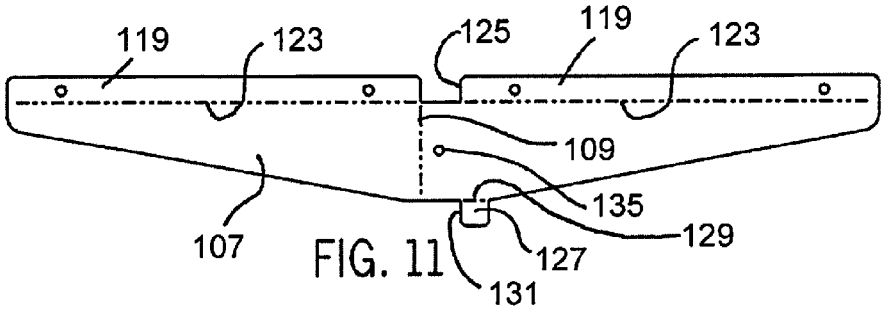
FIG. 11 is a flat blank for making a bracket of FIG. 8.

Referring now to FIGS. 1-2, 6B-9 and 11, a unique and advantageous aspect of the rack 10 embodiment is the robust bracket 13, 15, 17, 19 design which is both elegant and enables presentation of merchandise completely around rack 10. In the examples, brackets 13, 15, 17, 19 may be generally "L-shaped," meaning that each beam 99, 101 may be angularly spaced at approximately a 90° angle (i.e., at approximately a right angle or approximately orthogonal) from the other. The generally L-shape appearance of bracket 13, 15, 17, 19 is particularly apparent when viewing such bracket in a top (or bottom) plan view as illustrated in FIGS. 7A-7B and 11. A precise right angle or precise L-shape is not required and deviation from such a right angle or L-shape for the beam 99, 101 angular relationship is contemplated within the scope of the invention.

The generally L-shaped configuration may be produced by bending or folding a flat, planar bracket blank 107 of material (FIG. 11) along a crease or fold line 109 such that the resultant beams 99, 101 are angularly spaced at about a 90° angle from the other with beam 99 bent in the forward direction. Inner end 113 of each beam 99, 101 is on an opposite side of fold line 109 and beams 99, 101 are adjoined at the fold line 109 in the examples. Orientation and spacing of beams 99, 101 at about a 90° angle from the other is ideal for use of a bracket 13, 15, 17, 19 with a four-sided pole 39 because, when two brackets (e.g., brackets 13, 15) are at a single bracket mounting location 67, a beam 99, 101 faces outwardly from each side of pole 39. As illustrated in FIGS. 1-7B, if a pair of brackets 13, 15 or 17, 19 are implemented at the same bracket mounting location 67, 69, then each adjacent beam 99, 101 of the brackets 13, 15 or 17, 19 is also at approximately at a 90° angle (i.e., approximately a right angle or approximately orthogonal) relative to the other adjacent beams.

What results in such an embodiment is a spoke-like appearance with the hub being pole 39 and the spokes being beams 99, 101 extending radially outward from pole 39. This arrangement enables respective shelves 21, 23, 25, 27, 29, 31, 33, 35 to be supported by respective brackets 13, 15, 17, 19 completely around rack 10 for improved merchandise presentation. It is again to be understood that an approximate 90° angle between beams 99, 101 one from the other is desirable but not required because other angles could be utilized. For example, a bracket for use with a three-sided pole 39 might incorporate an angle of 120° between adjacent beams.

Referring to FIGS. 7A-11, each adjoined beam 99, 101 of a bracket 13, 15, 17, 19 may include a web portion 111, an adjoined inner end 113 and a free outer end 115. Inner end 113 includes portions of beam 99, 101 near the fold line 109 defining a terminal end of beams 99, 101 because inner, as used herein, is a relative term. It is not necessary that beams 99, 101 are adjoined at a fold line 109 because beams 99, 101 may be adjoined, such as by welding or mechanical fasteners, near or proximate the inner ends 113. Adjoined merely refers to beams 99, 101 being in connection or contact. Inner end 113 is deemed inner because of its proximity adjacent to pole 39 when bracket 13, 15, 17, 19 is attached to pole 39 as illustrated in the examples. Each beam 99, 101 extends from adjoined end 113 to a free end 115. Free end 115 can also be considered an outer end because such free end 115 of respective beam 99, 101 is a beam 99, 101 end furthest from pole 39 also as illustrated in the examples.

Web portion 111 of each beam 99, 101 may be substantially flat or planar providing beams 99, 101 which may be substantially flat or planar. Such web portion 111 may be substantially vertical to provide torsional rigidity and prevent downward bending or sagging of beam 99, 101 when a shelf, e.g., shelf 21, supported by beam 99, 101 is loaded with merchandise. Web portion 111 of each beam 99, 101 may be tapered or narrowed vertically toward free end 115 along lower edge 117 to provide improved clearance between beam 99, 101 and a shelf or other object beneath beam 99, 101. In such embodiments, beam 99, 101 would have a greater vertical dimension at adjoined end 113 than free end 115 with lower edge 117 of each beam 99, 101 including a tapered portion between beam ends 113, 115.

To further strengthen each beam 99, 101 and provide torsional rigidity, each beam 99, 101 of each bracket 13, 15, 17, 19 may include a substantially planar flange 119 at an upper edge 121 of each beam 99, 101 which may be at about 90° angle (i.e., a substantially right angle) to web portion 111. Flange 119 may be formed by bending or folding flange 119 in planar bracket blank 107 along crease or fold line 123 (FIG. 11). Blank 107 may be stamped from a piece of flat metal sheet material for reasons of cost and ease of use. Materials such as steel, aluminum, or any other material of sufficient strength may be utilized for brackets 13, 15, 17, 19.

Figure 8:
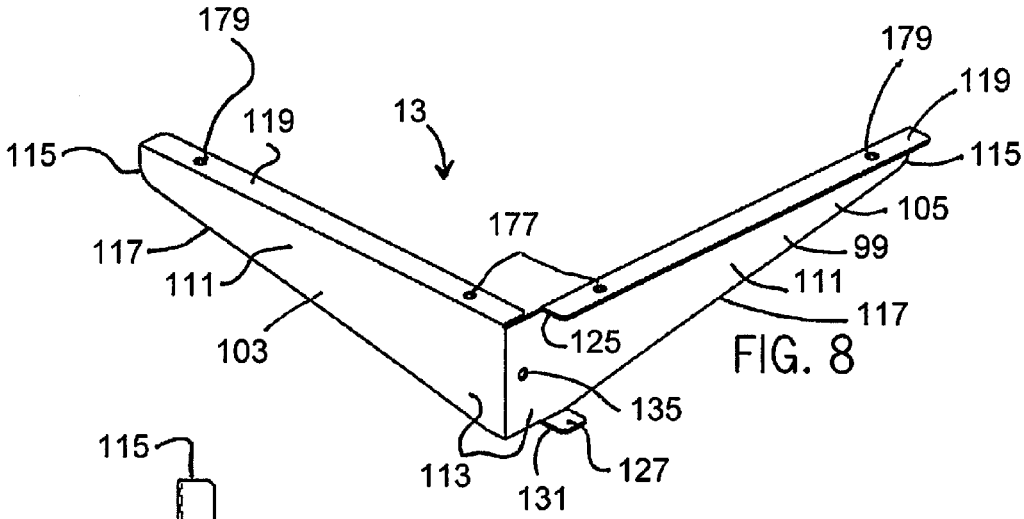
FIG. 8 is an enlarged perspective view of a bracket of the display rack of FIG. 1.
Figure 9:
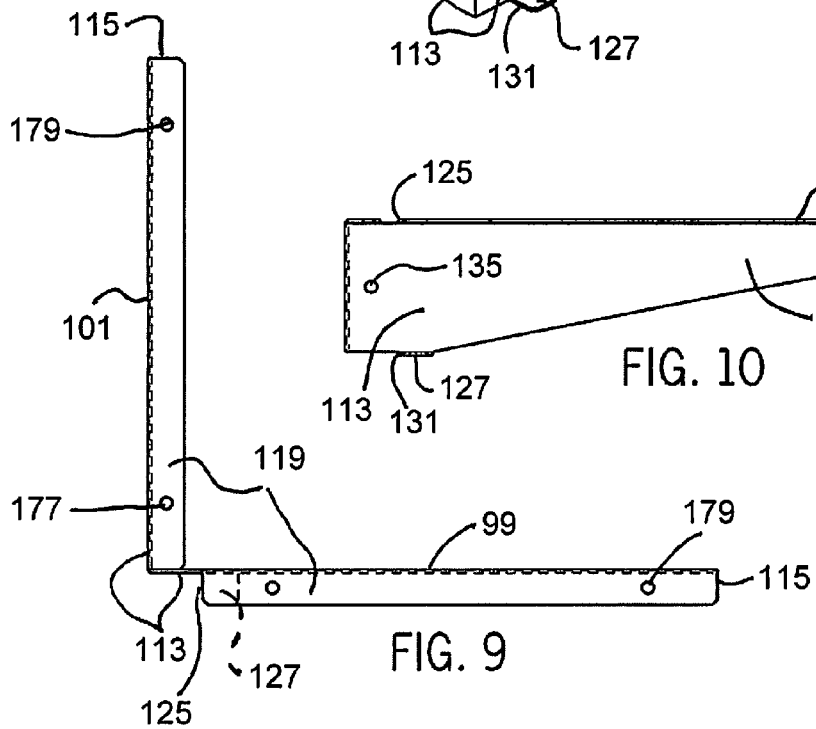
FIG. 9 is a top plan view of the bracket of FIG. 8.
Figure 10:
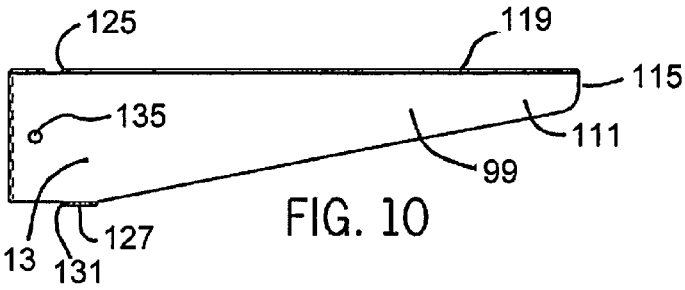
FIG. 10 is a side elevation view of the bracket of FIG. 8.

Referring to the example of FIG. 8, flange 119 of beams 99, 101 may be bent toward trailing side 105 and away from leading side 103 of each beam 99, 101. Bending flange 119 away from trailing edge 105 enables each shelf 21, 23, 25, 27, 29, 31, 33, 35 to rest against leading side 103 and enables flange 119 to provide lateral support for the respective bracket 13, 15, 17, 19 for the reasons described below.

Figure 6A:
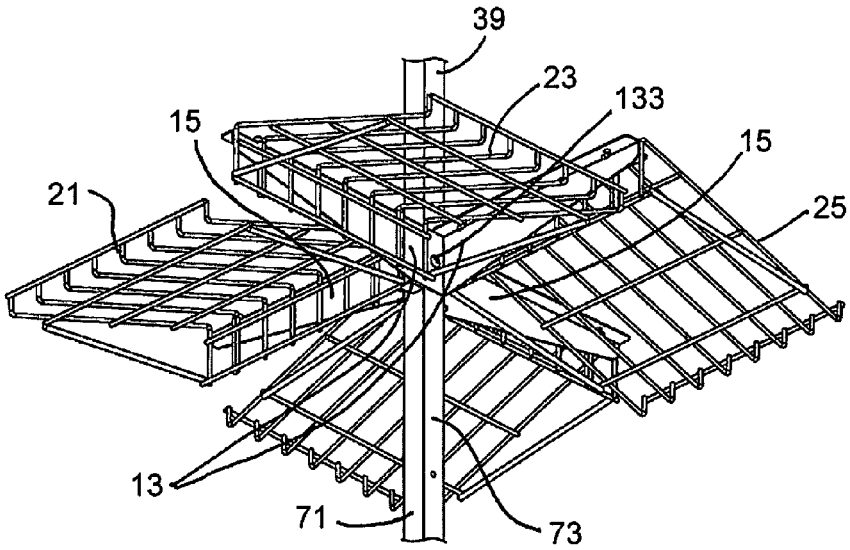
FIG. 6A is an enlarged view of brackets and shelves of the display rack of FIG. 1.
Figure 6B:
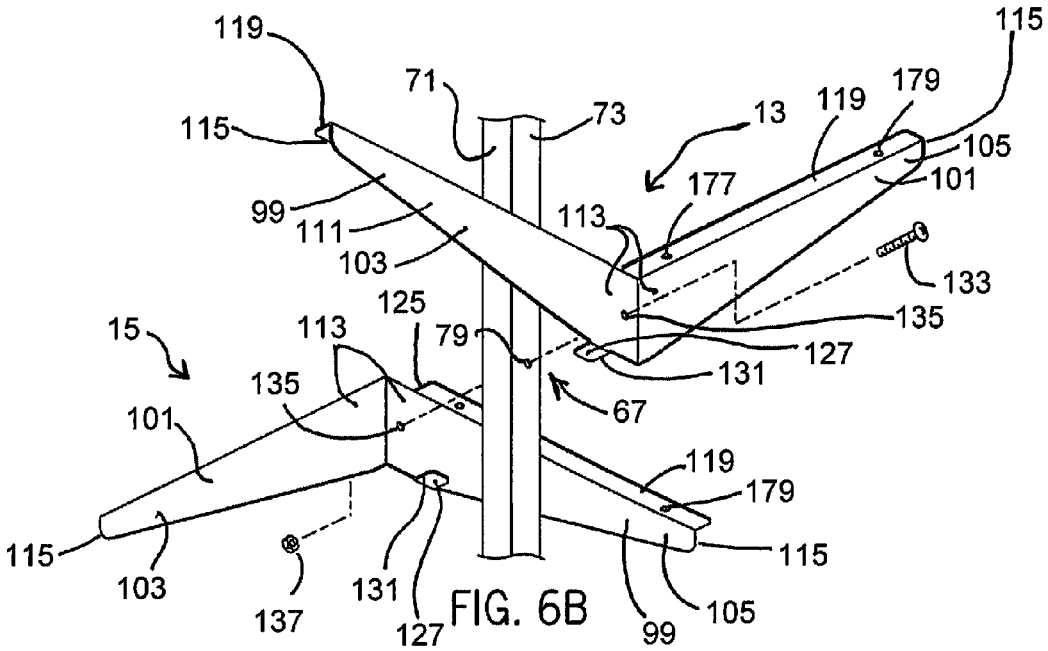
FIG. 6B is an exploded view of the brackets of FIG. 6A, but with the shelves removed.
Figure 7A:
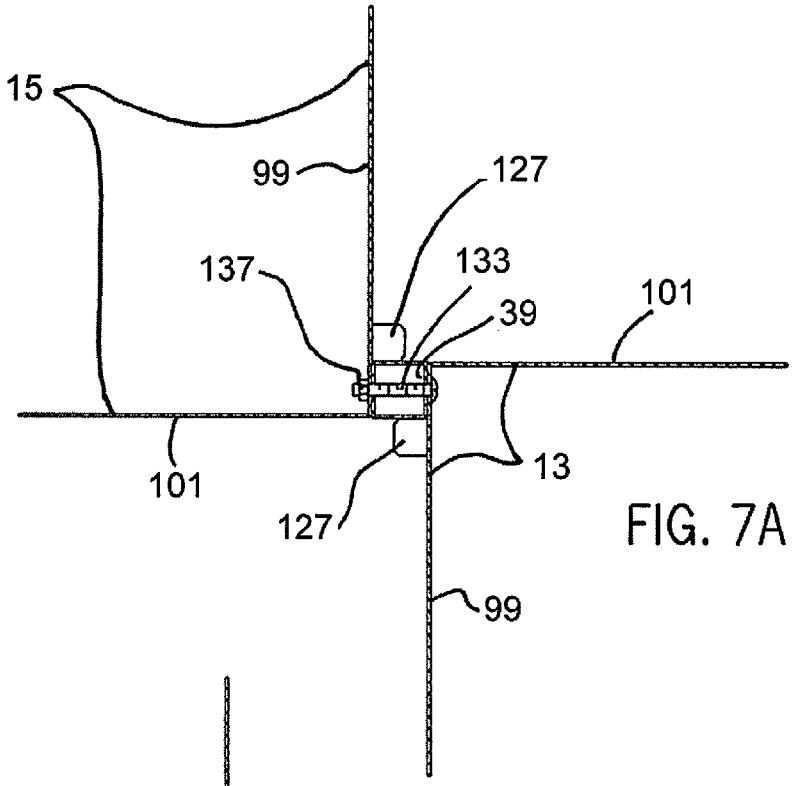
FIG. 7A is a section view taken along section 7A-7A of FIG. 3.
Figure 7B:
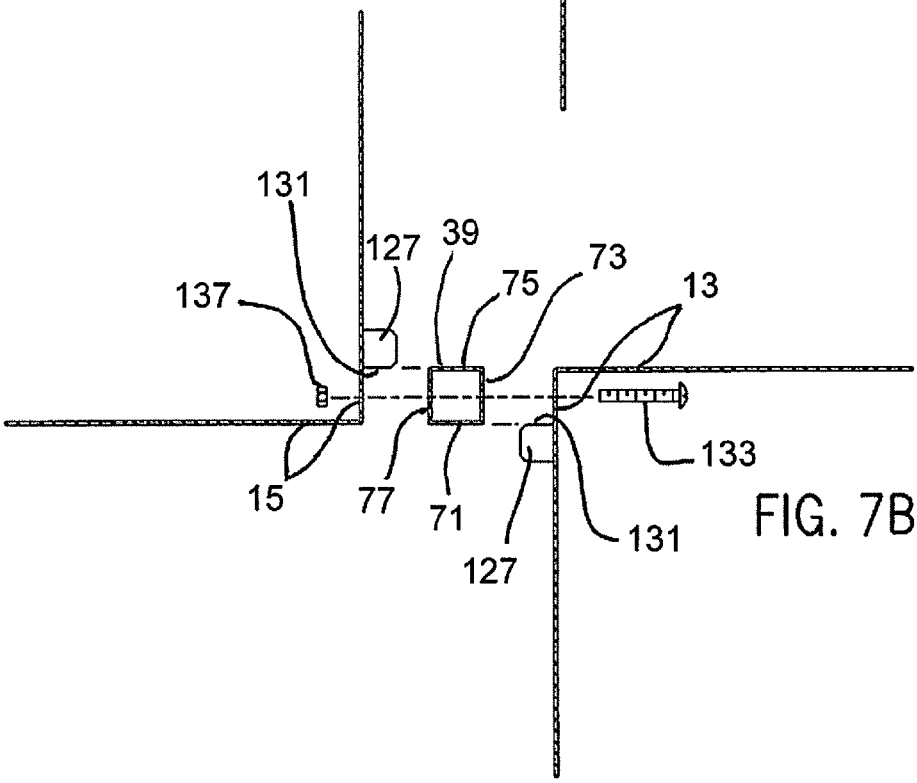
FIG. 7B is an exploded view of the brackets and support of FIG. 7A.

Each bracket 13, 15, 17, 19 may include structure to improve bracket lateral and vertical stability with respect to pole 39, particularly when shelves, e.g., shelves 21 and 23, are loaded with merchandise. Referring then to FIGS. 6B, 7A and 7B, lateral stability may be improved by surface-to-surface contact between bracket 13, 15, 17, 19 and adjacent vertical wall surfaces, e.g., surfaces 71 and 73 and 75 and 77. Reference will be made to FIG. 6B and attachment of bracket 13 to pole 39 as illustrated therein, it being understood that brackets 15, 17 and 19 may be secured to pole 39 in the same manner. Referring then to FIG. 6B and bracket 13, adjoined inner end 113 of first beam 99 trailing side 105 may extend along and against a first vertical wall 73 of pole 39. Further, flange 119 of the one beam 99 may have an inward flange edge 125 (FIGS. 6B, 8-9 and 11) provided to extend along and against a vertical pole wall 71 adjacent to the first vertical wall 73. The surface-to-surface contact between the above-described flange edge 125 and pole 39 wall 71 surface limits lateral rotation of bracket 13 with respect to pole 39, thereby laterally stabilizing bracket 13 with respect to pole 39.

Referring again to FIGS. 6B, 7A and 7B, vertical and lateral stability of bracket 13, and brackets 15, 17, 19, may be improved by means of a tab-type protrusion 127 extending out from a lower edge 117 of web portion 111 of beam 99. In the examples, protrusion 127 is bent or folded along crease or fold line 129 (FIG. 11) at about 90° relative to web portion 111 of beam 99 out from trailing side 105, with tab-type protrusion 125 having an inward edge 131 vertically aligned with inward flange edge 125. In the examples, inward flange edge 125 and inward edge 131 of protrusion 127 comprise upper and lower vertically aligned protrusions. Surface-to-surface contact between protrusion 127 inward edge 131 and pole 39 vertical wall 71 (the same wall 71 as contacted by flange inward edge 125), limits any downward rotation of the respective bracket 13, 15, 17, 19 with respect to pole 39, thereby stabilizing the respective bracket 13, 15, 17, 19 vertically and, along with flange edge 125, laterally stabilizes the respective bracket 13, 15, 17, 19 with respect to pole 39.

Yet another unique and advantageous aspect of rack 10 embodiment illustrated in FIGS. 1-7B is that each bracket 13, 15, 17, 19 may be secured to pole 39 at a bracket mounting location 67 or 69 by a single mechanical fastener 133. Further, two bracket pairs, e.g., brackets 13 and 15, may be secured to pole 39 at the bracket mounting location 67 or 69 both by the same single fastener 133. This arrangement reduces the number of parts needed for the rack 10 and makes assembly and disassembly of each bracket 13, 15, 17, 19 to or from rack 10 more rapid and efficient.

FIGS. 6A-7B and 10-11 illustrate one embodiment of bracket mounting structure. Reference will again be made to FIG. 6B and bracket 13, it being understood that brackets 15, 17, 19 may be mounted in the same manner. Referring then to bracket 13 and FIG. 6B, a trailing side 105 of beam 99 (same as trailing side 105 of beam 99 for bracket 15 in FIG. 6B) of bracket 13 (or beam 99 of brackets 15, 17, 19) is positioned to abut a side 73 (or side 77 opposed from side 73) of pole 39. Each adjoined end 113 of beam 99 defines a mounting aperture 135, or hole, which may be sized to receive a bolt-type mechanical fastener 133. Fastener 133 is sized to extend through mounting aperture 135 and into a mounting passage 79 or 81 through pole 39 when in alignment as indicated by the dotted line in FIG. 6B. Securement of nut 137 on fastener 135 extending beyond bracket 13 attaches bracket 13 to pole 39.

Referring again to FIG. 6B, fastener 133 may be further sized to attach two brackets 13 and 15 (or brackets 17 and 19) at each bracket mounting location 67 or 69. In this example, a trailing side 105 of beam 99 of two brackets 13 and 15 is positioned to abut a side 75 or 77 of pole 39. A single fastener 133 may then be inserted through mounting aperture 135 of both the first and second bracket 13 and 15 or 17 and 19 and through mounting passage 79 or 81 of pole 39. Securement of nut 137 on fastener 135 attaches both brackets 13 and 15 (or brackets 17 and 19) to pole 39.

Referring to FIGS. 1-4, 6A and 12, a shelf 21, 23, 25, 27, 29, 31, 33, 35 may be secured with respect to leading side 103 of each beam 99, 101. In the examples, each shelf 21, 23, 25, 27, 29, 31, 33, 35 extends away from leading side 103 in the forward direction. Each shelf 21, 23, 25, 27, 29, 31, 33, 35 is shown as a wire frame shelf with a front side 161, a vertical rear side 163 and lateral sides 165, 167. Each shelf may further include an upper surface 169 for placement of merchandise thereon. Upper surface 169 may be sloped downward toward front side 161 to allow merchandise on upper surface 169 to slide by means of gravity toward front side 161 until stopped by upright front wall 171. Shelves 21, 23, 25, 27, 29, 31, 33, 35 may be made of steel wire or other suitable material.

Figure 12:
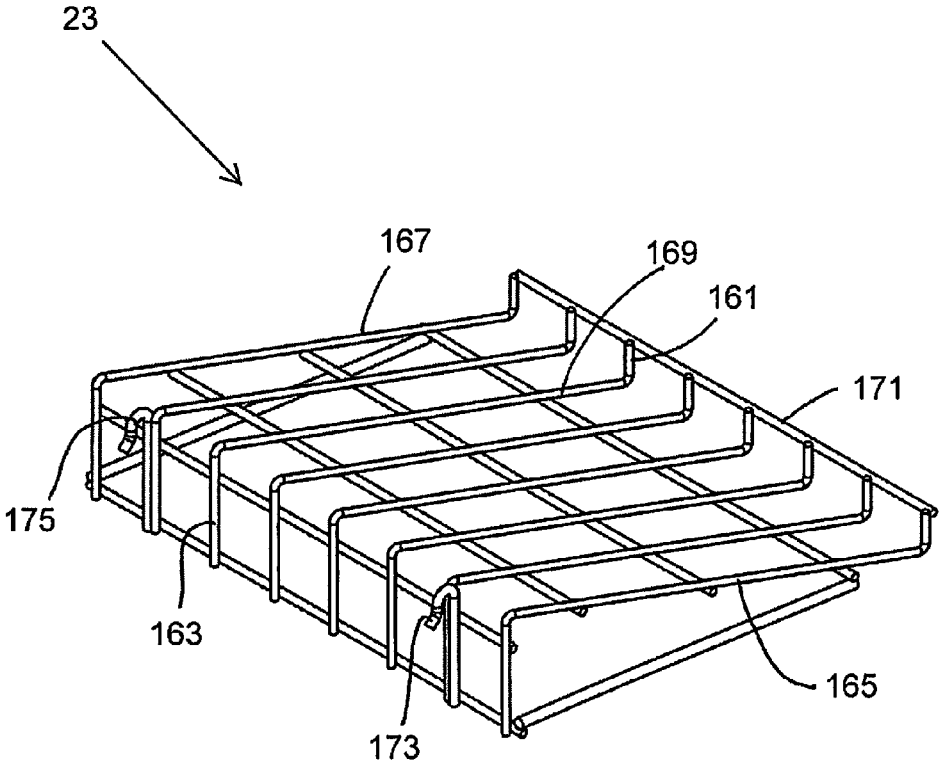
FIG. 12 is a perspective view of an exemplary shelf.

Referring to FIG. 12, each shelf 23 may include a pair of downwardly directed hooks 173, 175. Each hook 173, 175 is sized and spaced to fit into an inboard or outboard hole 177, 179 in flange 119. When hook 173, 175 is inserted into corresponding hole 177, 179, shelf rear side 163 rests against and abuts leading side 103 of beam 99, 101. Shelf rear side 163 may rest against and abut leading side 103 of beam 99 in embodiments where flange 119 extends away from trailing side 105 and is clear of shelf 21, 23, 25, 27, 29, 31, 33, 35 rear side 163. The combination of hooks 173, 175 in a respective hole 177, 179 and abutment of rear side with the planar surface of beam 99, 101 leading side, supports each shelf 23 extending laterally away from leading side 103 of beam 99, 101 and supports a shelf 21, 23, 25, 27, 29, 31, 33, 35 with respect to leading side 103 of beam 99, 101.

While merchandise supports in the form of shelves are illustrated, it should be understood that other types of merchandise supports may be implemented. For example, one or more shelves 21, 23, 25, 27, 29, 31, 33, 35 could be replaced with hangers (not shown) attached to a respective beam 99, 101 of one or more of brackets 13, 15, 17, 19 with the hangers including hooks or rods for supporting hanging merchandise items from rack 10. In such an embodiment, the hangers may face in the common forward direction providing merchandise accessibility entirely around rack 10.

Because each leading side 103 faces in a common forward clockwise or counterclockwise direction, each shelf 21, 23, 25, 27, 29, 31, 33, 35 also extends away from beam 99 in the common forward direction. Each single row of shelves 21, 23, 25, 27 and/or shelves 29, 31, 33, 35 supported by brackets 13, 15 at mounting location 67 or brackets 17, 19 at mounting location 69 provides the rack 10 with a type of "pinwheel" appearance with each shelf 21, 23, 25, 27, 29, 31, 33, 35 radially outward from pole 39 and facing laterally outward entirely around pole 39 like the blades of a pinwheel.

The result of the foregoing rack 10 structure, is that merchandise can be presented to customers in different directions entirely around rack 10. This represents an improvement over racks which are capable of presenting merchandise from less than entirely around the rack. Such a presentation with merchandise facing the customer entirely around the rack 10 is highly visible to the customer and enables the customer to access the merchandise from any side of the rack 10, potentially increasing sales. Shelves 21, 23, 25, 27, 29, 31, 33, 35 can be stacked vertically along pole 39 to provide for vertical presentation of merchandise on shelves 21, 23, 25, 27, 29, 31, 33, 35. Vertical stacking of shelves 21, 23, 25, 27, 29, 31, 33, 35 provides an opportunity to minimize the footprint of rack 10, conserving valuable retail floor space.

The invention is not limited to the particular details of the apparatus depicted and other modifications and applications may be contemplated. By way of example only, a quantity and arrangement of brackets 13, 15, 17, 19 and shelves 21, 23, 25, 27, 29, 31, 33, 35 other than as illustrated and described may be provided in other embodiments of a rack. Certain other changes may be made in the above-described apparatus without departing from the true spirit and scope of the present invention.

While the principles of the invention have been shown and described in connection with specific embodiments, it is to be understood that such embodiments are by way of example and are not limiting.

The invention claimed is:

1. A display rack, comprising:

a support defining an upright axis and having a plurality of mounting locations spaced vertically from each other along the axis;

a pair of generally L-shaped brackets attached to the support at each mounting location, each bracket including adjoined first and second substantially vertical beams having a leading side, adjoined inner ends, free outer ends and a substantially planar flange at an upper beam edge which defines shelf-supporting holes, each beam extending outward from the inner end and support such that each leading side faces in a common forward direction which is one of clockwise and counterclockwise about the support axis, the brackets being attached to the support such that each adjacent beam is at approximately a right angle to the other adjacent beam; and a merchandise support shelf secured with respect to the leading side of each beam and extending therefrom in the forward direction, each shelf being secured with respect to the leading side by a set of hooks extending from a rear side of the shelf into a corresponding shelf-supporting hole.

2. The display rack of claim 1 wherein each of the beams is substantially flat.

3. The display rack of claim 2 wherein each generally L-shaped bracket is formed of a bent sheet material.

4. The display rack of claim 1 wherein each beam has a greater vertical dimension at the adjoined inner end than the free outer end, with a lower edge of each beam including a tapered portion between the beam ends.

5. The display rack of claim 1 wherein each beam further has a trailing side and the flange is bent along the upper edge of the beam outward from the trailing side to a substantially right angle with respect to the trailing side.

6. The display rack of claim 1 wherein the support is a vertical pole with a polygonal cross-section and including at least one pair of opposed first and second parallel vertical walls.

7. The display rack of claim 6 wherein:

the adjoined inner end of the first beam extends along the first vertical wall of the pole; and the flange of the first beam has an inward flange edge extending along a vertical pole wall adjacent to the first wall, thereby limiting lateral rotation of the generally L-shaped bracket with respect to the pole in a direction opposite the leading side, thereby stabilizing the generally L-shaped bracket with respect to the pole.

8. The display rack of claim 7 wherein the generally L-shaped bracket includes a protrusion extending from the first beam along the same pole wall as the inward flange edge, thereby limiting downward rotation of the generally L-shaped bracket with respect to the pole and further stabilizing the generally L-shaped bracket with respect to the pole.

9. The display rack of claim 8 wherein the protrusion is a tab at a lower edge of the first beam, the tab having an inward tab edge vertically aligned with the inward flange edge.

10. The display rack of claim 1 wherein the adjoined inner end of the first beam defines a mounting aperture receiving a fastener extending therethrough and into the support.

11. The display rack of claim 10 wherein:

the support includes at least one pair of opposed first and second parallel vertical walls;

each mounting location is defined by a mounting passage through the pair of the opposed parallel vertical walls; and the pair of generally L-shaped brackets are attached to the support with a single fastener extending through the mounting passage of the support and through the mounting apertures of each of the generally L-shaped brackets.

12. The display rack of claim 11 wherein:

the support is a vertical pole with a polygonal cross-section; and the adjoined inner end of the first beam of each generally L-shaped bracket extends along one of the opposed parallel vertical walls of the pole.

13. The display rack of claim 12 wherein each generally L-shaped bracket includes lower and upper vertically aligned protrusions extending from the adjoined inner end of the first beam and along a vertical pole wall adjacent to the corresponding one of the parallel walls, thereby limiting lateral rotation of the generally L-shaped brackets with respect to the pole.

14. The display rack of claim 13 wherein:

the upper protrusion is an inward edge of the flange extending against the corresponding vertical pole wall; and the lower protrusion is a tab at the lower edge of the first beam, the tab having an inward tab edge vertically aligned with the inward flange edge.

* * * * *